United States Patent [19]

Evans et al.

[11] 4,435,670

[45] Mar. 6, 1984

[54] ENERGY CONSERVING INSTANT-START SERIES-SEQUENCE FLUORESCENT LAMP SYSTEM WITH OVERCURRENT PROTECTION

[75] Inventors: George S. Evans, Caldwell; John F. Gilmore, Verona; Edward W. Morton, Teaneck, all of N.J.

[73] Assignee: North American Philips Electric Corp., Bloomfield, N.J.

[21] Appl. No.: 300,319

[22] Filed: Sep. 8, 1981

[51] Int. Cl.[3] ..... H01J 7/44

[52] U.S. Cl. ..... 315/58; 315/177; 315/233; 315/257; 315/323

[58] Field of Search ..... 315/58, 71, 177, 185 R, 315/254, 257, 276, 323, 233

[56] References Cited

U.S. PATENT DOCUMENTS

| | | | |
|---|---|---|---|
| 3,954,316 | 3/1976 | Luchetta | 315/96 |
| 3,956,665 | 5/1976 | Westphal | 315/95 |
| 4,010,399 | 3/1977 | Bessone et al. | 315/101 |
| 4,163,176 | 7/1979 | Cohen et al. | 315/53 |

*Primary Examiner*—Harold Dixon

[57] ABSTRACT

An energy-saving instant-start series-sequence fluorescent lamp system includes power-reducing capacitor means connected in series circuit arrangement with one or both lamps in a two-lamp system. A protective device is connected in circuit with a first lamp of the system so that in the event the second lamp fails to operate and causes a high current to flow through the first lamp, the protective device reacts to prevent the system from being damaged. A lamp incorporating the power-reducing capacitor and protective device is also disclosed.

2 Claims, 3 Drawing Figures

ENERGY CONSERVING INSTANT-START SERIES-SEQUENCE FLUORESCENT LAMP SYSTEM WITH OVERCURRENT PROTECTION

CROSS-REFERENCE TO RELATED APPLICATION

In copending application Ser. No. 300,347, filed concurrently herewith, by G. S. Evans et al., and assigned to the present assignee, is disclosed an energy-saving instant-start series-sequence fluorescent lamp system including an energy reduction capacitor connected in series circuit arrangement with one or both lamps in a two-lamp system. The energy reduction capacitor is housed within the stem member cavity of the lamps to provide a uniform appearance for the lamps by hiding the capacitor.

BACKGROUND OF THE INVENTION

This invention relates to energy saving fluorescent lamp systems and, in particular, to a lamp system having a built-in protective device for preventing overcurrent in case one of the lamps of a two-lamp system fails to operate and to a fluorescent lamp structure therefor. In recent years, there has been interest in reducing the energy consumed by existing fluorescent lamp systems. A number of devices have been disclosed for accomplishing this purpose. One such device is disclosed in U.S. Pat. No. 3,954,316 dated May 4, 1976, issued to J. F. Luchetta. The Luchetta patent describes an attachment for inclusion in a two-lamp rapid-start-type fluorescent lamp. It comprises an isolation transformer and a capacitor to reduce the electrical power consumption of a lamp. A capacitor is placed in series with the existing power factor correcting capacitor in the standard rapid-start ballast and thereby reduces the current after energization. The isolation transformer provides heater current for one of the electrodes of one of the lamps and also functions to improve the power factor.

Another energy saving device is disclosed in U.S. Pat. No. 3,956,665 dated May 11, 1976, issued to J. A. Westphal. The Westphal patent discloses an energy saving device for replacing a fluorescent lamp in a two-lamp serially connected fluorescent fixture. Frequently, in order to save energy, every other set of two fluorescent lamps are disconnected with their ballast remaining in the circuit. The unloaded ballasts have an undesirable inductive power factor. The Westphal device permits the use of one of the two lamps by placing a capacitor in series with the lamp, thereby providing somewhat improved light distribution and power factor.

In U.S. Pat. No. 4,082,981 dated Apr. 4, 1978, issued to Morton et al. is disclosed an energy saving device for a rapid-start series-sequence type ballast for two low pressure mercury discharge lamps. The apparatus utilizes switch means in conjunction with a capacitor to limit the current supplied to the lamps after the lamps are energized.

In U.S. Pat. No. 4,163,176 dated July 31, 1979, issued to Cohen et al. is disclosed an instant-start fluorescent lamp and an elongated extension base housing a capacitance for reducing current flow through the lamp.

In U.S. Pat. No. 4,010,399 dated Mar. 1, 1977, issued to Bessone et al. is disclosed a switching circuit for a fluorescent lamp with heated filaments. The switching circuit may be held within one stem member cavity of the fluorescent lamp.

SUMMARY OF THE INVENTION

The present invention operates in combination with an instant-start series-sequence fluorescent lamp system, which system includes a pair of input terminal means for connecting the system to a power source. The system further includes a pair of fluorescent lamp means each comprising an elongated tubular vitreous envelope enclosing a discharge-sustaining filling and carrying phosphor means on the inner surface thereof. Substantially hollow vitreous re-entrant stem presses are sealed to each end portion of the envelope. The stem presses have lead-in means sealed therethrough and operatively support electrodes within the envelope proximate each end portion thereof.

The system further includes transformer means including a primary winding, a secondary winding and an auxiliary winding. The first of the lamp means has one of the electrodes in circuit between one of the input terminal means and one end of the primary winding. The other of the electrodes of the first lamp means is in circuit with a point common to one end of the secondary winding and one end of the auxiliary winding. The second of the lamp means has one of the electrodes in circuit between the other of the input terminals and the other end of the primary winding. The other of the electrodes of the second lamp means is in circuit with the other end of the secondary winding. The other end of the auxiliary winding is in circuit with one end of the primary winding. Intermediate capacitor means is in circuit between the common point and the other electrode of the first lamp means.

The improvement comprises a power reducing capacitor means of predetermined capacitance in series circuit with the first lamp means and a protective device comprising one of (1) a current responsive fusible member which is in series circuit with the power-reducing capacitor means and is responsive to a current overload to render the lamp inoperative, and (2) a voltage-responsive switch means which is connected in parallel with the power-reducing capacitor means and which normally displays a high impedance. The voltage-responsive switch means is responsive to a predetermined voltage developed across the power-reducing capacitor to switch to a low-impedance state and effectively remove the power-reducing capacitor means from circuit, whereby the lamp system is protected from overload conditions encountered upon failure of either the first or second lamp means. A retrofit fluorescent lamp incorporating the present invention adapted for operation with existing instant-start series-sequence two-lamp systems is also disclosed.

BRIEF DESCRIPTION OF THE DRAWINGS

For a better understanding of the invention, reference may be had to the preferred embodiments exemplary of the invention, shown in the accompanying drawings in which.

DESCRIPTION OF THE PREFERRED EMBODIMENTS

Figure 1:
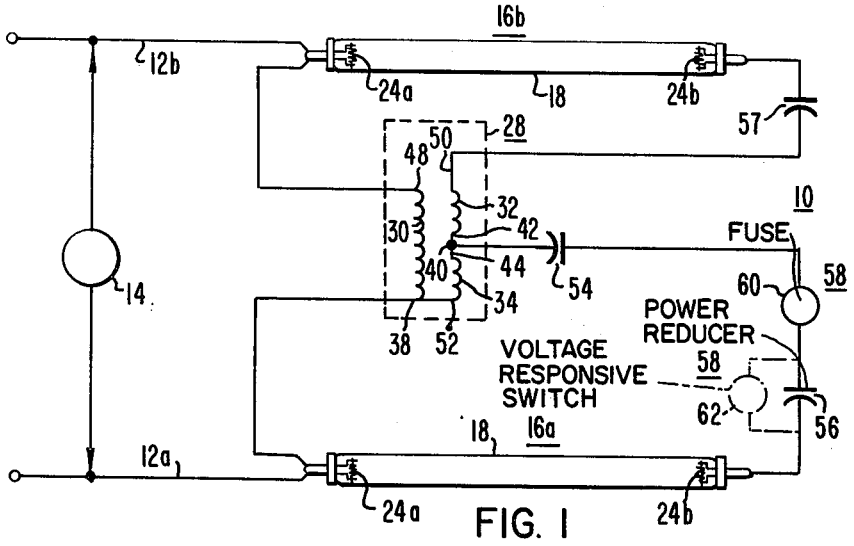
FIG. 1 is a schematic diagram showing an instant-start series-sequence fluorescent lamp system with a power-reducing capacitor means and the protective device of the present invention.
Figure 2:
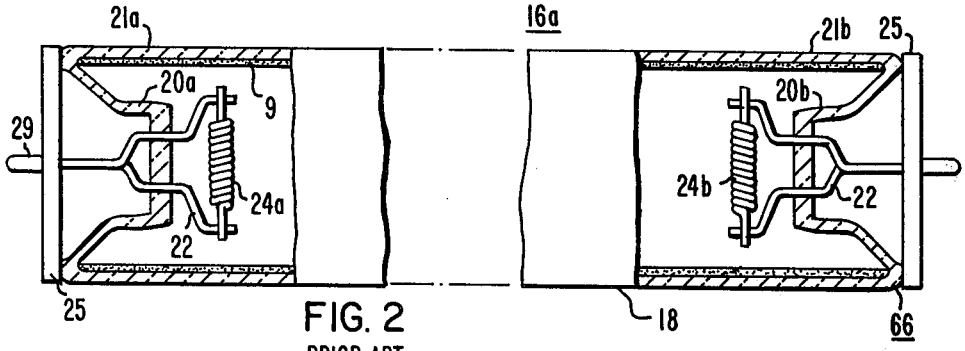
FIG. 2 PRIOR ART
FIG. 2 is a sectional plan view, partially broken away, of a prior art instant-start fluorescent lamp.

In FIG. 1 is shown an instant-start series-sequence fluorescent lamp system 10. The system 10 includes a pair of input terminal means 12*a*, 12*b* for connecting the system 10 to a power source 14. The system further includes a pair of fluorescent lamp means 16*a*, 16*b* each comprising an elongated tubular vitreous envelope 18 enclosing a discharge-sustaining environment and filling, typically mercury vapor at low pressure with a small amount of inert gas, usually argon, for starting. The envelope 18, typically made of glass, carries a phosphor means 19, shown in FIG. 2 as is well known in the art, on the inner surface thereof. Substantially hollow vitreous re-entrant stem presses 20*a*, 20*b* are sealed to each end portion 21*a*, 21*b* of the envelope 18. Each stem press 20*a*, 20*b* has lead-in means 22 sealed therethrough and operatively supporting electrodes 24*a*, 24*b* within the envelope 18 proximate each end portion 21*a*, 21*b* thereof. End cap means 25 are sealed to each envelope end portion 21*a*, 21*b* and each support a single contact member 29 for energizing the lamp means 16*a*, 16*b* from the lamp system 10. The lead-in means 22 electrically connect to the single contact member 29.

System 10 further includes transformer means 28 including a primary winding 30, a secondary winding 32 and an auxiliary winding 34. A first of the lamp means 16*a*, has one of the electrodes 24*a* in circuit between one of the input terminals 12*a* and one end 38 of the primary winding 30. The other of the electrodes of the first lamp means 16*a* is in circuit with a point 40 common to one end 42 of the secondary winding 32 and one end of the auxiliary winding 34. The second of the lamp means 16*b* has one of the electrodes 24*a* in circuit between the other of the input terminals 12*b* and the other end 48 of the primary winding 30. The other of the electrodes 24*b* of the second lamp 16*b* is in circuit with the other end 50 of the secondary winding 32. The other end 52 of the auxiliary winding 34 is in circuit with the one end 38 of the primary winding. Intermediate capacitor means 54 is in circuit between the common point 40 and the other electrode 24*b* of the first lamp 16*a*. Typically the transformer 28 is a step-up autotransformer. The intermediate capacitor means 54 is typically an internal capacitance of the transformer 28. The electrodes 24*a*, 24*b* of the lamp means 16*a*, 16*b* are not preheated and are started by the application of the high voltage. Typically the auxiliary winding 34 provides about 565 volts to start the first lamp 16*a*. The voltage across the second lamp 16*b* is the vector sum of the primary, auxiliary and secondary voltages, with the auxiliary voltage out-of-phase and, therefore, subtracting from the sum of the other two resulting in about 200 volts across the second lamp 16*b* before the first lamp 16*a* starts. When the first lamp 16*a* starts and current flow begins, the voltage across the intermediate capacitor means 54 causes the phase angle of the auxiliary voltage to shift causing it to add to the primary and secondary voltages thus starting the second lamp 16*b*. The typical operating voltage of an F96T12 lamp is about 200 volts RMS with a normal operating current of 430 mA RMS. Thus the normal ballast output is 430 mA at 400 volts. The instant-start series-sequence fluorescent lamp system as described thus far is generally conventional.

The improvement comprises a power reducing capacitor means 56 of predetermined capacitance in series circuit with the first lamp means 16*a* and a protective device 58. A second power reducing capacitor means is typically included in series circuit with the second lamp 16*b*, as is known in the art. The protective device 58 comprises one of (1) a current responsive fusible member 60 which is in series circuit with the power reducing capacitor 56 and is responsive to a current overload to render the lamp system inoperative, and (2) a voltage-responsive switch means 62 which normally displays a high impedance. The voltage-responsive switch 62 is responsive to a predetermined voltage developed across the power-reducing capacitor 56 to switch to a low-impedance state and effectively remove the power-reducing capacitor 56 from the circuit, whereby the lamp system 10 is protected from overload conditions encountered upon failure of the second lamp 16*b*.

With the lamp system 10, shown in FIG. 1, utilizing the power-reducing capacitor means 56 in series circuit arrangement with the first lamp 16*a* and second power-reducing capacitor 57 in series circuit with second lamp 16*b*, the lamp current is reduced together with a reduction in the total power consumed by the lamp system 10 utilizing, for example, a ballast manufactured by the Universal Manufacturing Corporation designated No. 806-BR, which is the equivalent of the transformer 28 and the intermediate capacitor means 54, shown in FIG. 1, and for both the power-reducing capacitor means 56 and second power reducing capacitor 57, 4 microfarad capacitors the total power consumed by the lamp system 10 is reduced to 60% of that consumed by the lamp system without the power-reducing capacitor means 56 and second power reducing capacitor 57. The system current is reduced so that with the pairs of lamps 16*a*, 16*b* and the power-reducing capacitor means 56 and second power reducing capacitor 57, operating normally, the ballast life is extended.

It has been found, though, that the transformer 28 may be damaged if the second lamp 16*b* does not start or fails during operation or the second power-reducing capacitor 57 in series circuit therewith fails for some reason. If either the second lamp 16*b* or the second power-reducing capacitor 57 fails, a current will flow through the first lamp 16*a* and through the auxiliary winding 34 and the power-reducing capacitor means 56. Normally, in a non-energy saving system, i.e. one without the power reducing capacitor means 56 and second power reducing capacitor 57 with the standard F96T12 lamps, both operating, the circulating current in the auxiliary winding 34 is about 50 mA. Failure of the second lamp 16*b* causes the circulating current in the auxiliary winding 34 to jump to about 200 mA. The transformer 28 will experience a rise in temperature but will not be destroyed. With the inclusion of the energy reduction capacitor 56, however, the circuit impedance is reduced and failure of the second lamp 16*b* or the second power-reducing capacitor 57 causes the circulating current to increase in the auxiliary winding 34 to about 400 mA. If the circulating current of 400 mA is permitted to continue, the auxiliary winding 34 will overheat and burn out and the transformer 28 will be destroyed.

The following test data is illustrative:

| 2-LAMP SERIES BALLAST, 120 VOLTS | | | |
|---|---|---|---|
| Operating Condition | Current, Milliamperes 1st Lamp | 2nd Lamp | Voltage Across Energy Reduction Capacitor 56a |
| 2-96 T12 lamps both on, No capacitor | 412 | 395 | No capacitor |
| Second lamp out, same as above | 192 | 0 | No capacitor |
| 2-96 T12 lamps, 2-4.0 Mfd. capacitors, both lamps on | 190 | 214 | 128 rms |
| Same as above, second lamp out | 402 | 0 | 236 rms |

From the above it is apparent that with the second lamp 16b not functioning, current through the first lamp 16a is about twice normal and the voltage across the power-reducing capacitor 56 is also about twice normal. This increase in the voltage across the power-reducing capacitor 56 can also lead to its premature failure. Thus, the protective device 58 of the present invention is required for protecting both the transformer 28 and the power-reducing capacitor 56.

Figure 3:
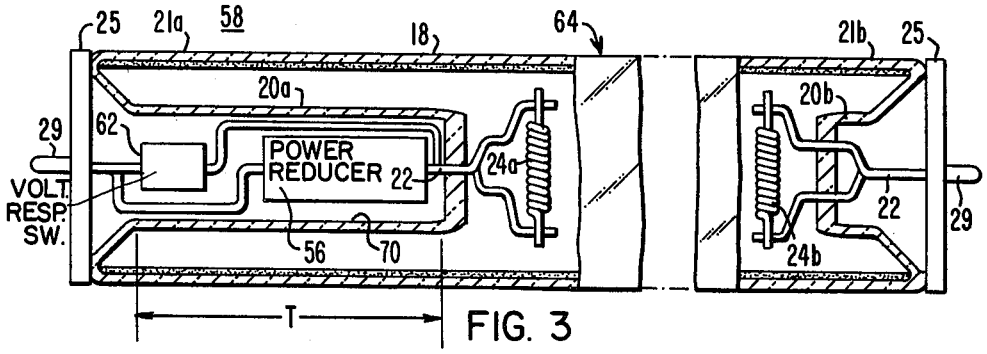
FIG. 3 is a sectional plan view, partially broken away, showing the position of the power-reducing capacitor means and the protective device within the stem press cavity of a retrofit fluorescent lamp.

With reference to FIG. 3 there is shown a retrofit fluorescent lamp 64 adapted for operation in an instant-start series-sequence two lamp system 10 as already described. Utilizing the retrofit lamp 64 the system operates with a power consumption which is reduced from that power consumption at which the lamp system 10 is rated to operate fluorescent lamps. The reference numerals shown in FIG. 3 are the same as those in FIGS. 1 and 2 when they identify like parts. The retrofit lamp 64 incorporates the features of the lamp means 16a, 16b together with the following additional features. At least one of the substantially hollow vitreous re-entrant stem presses 20a, 20b of the retrofit lamp 64 protrude into the space within the envelope 18 to form a cavity 70 within the one stem press 20a or 20b of predetermined size within one of the end portions 21a, 21b of the envelope 18 and which stem press cavity 70 is sealed from the environment contained within the envelope.

The retrofit fluorescent lamp further comprises the power-reducing capacitor means 56 which is of predetermined dimensions and capacitance and housed within the one re-entrant stem cavity 70 and in series circuit between the proximate electrode 24a and the proximate single contact member 29. The retrofit lamp further comprises the protective device 58 of predetermined dimensions and housed within the one re-entrant stem cavity 70 and is in circuit with the power-reducing capacitor 56. For an F96T12 lamp the stem press along the straight section identified as 'T' in FIG. 3, perferably is about 3.0 inches (7.62 cm.) in length and an inside diameter of 0.673 inch (1.709 cm.) to accommodate the power reducing capacitor 56 and the protective device 58. The power reducing capacitor 56 preferably is a tubular capacitor with axial leads. The capacitor 56 may have a maximum diameter of 0.59 inch (1.4986 cm.) and a maximum length of 1.87 inch (4.7498 cm.) so as to fit with ease into the cavity 70. The protective device preferably has a maximum diameter 0.59 inch (1.4986 cm.) and a maximum length of 1.0 inch (2.54 cm.). The protective device comprises either a current responsive fusible member 60 or the voltage-responsive switch 62 as already described. FIG. 3 show the protective device 58 has the voltage-responsive switch 62 in parallel circuit with capacitor 56. If the fusible member 60 is used instead, it is preferably placed within the other stem press 20b between the electrode 24b and contact 29.

When the protective device 58 is a current responsive fusible member 69 connected in series circuit arrangement as shown in FIG. 1 with the first lamp 16a, upon the second lamp 16b failing to operate and causing a high current to flow through the first lamp 16a, the fusible member 60 melts, thereby preventing the high current from damaging the lamp system 10. Utilizing 3.3 microfarad capacitors for the power reducing capacitors 56 and the second power reducing capacitor 57, it has been found that a fuse rated 300 mA works well. With the alternative voltage-responsive switch means 62 shown dashed in FIG. 1 connected in parallel circuit arrangement with the power-reducing capacitor 56, upon the second lamp 16b failing and causing an abnormally high voltage across the power-reducing capacitor 56, the voltage-responsive switch means 62 senses the abnormally high voltage and shorts the energy reduction capacitor 56 to prevent the lamp system 10 from being damaged. Utilizing for the 3.3 microfarad capacitors, for the power-reducing capacitor 56 and second power-reducing capacitor 57, a thermistor may be used for the by-pass means 62, such as manufactured by the Keystone Carbon Company Model No. RL34F3 having a rating of about 7 watts which will respond to a voltage of 180 volts RMS to conduct current and bypass the capacitor. Alternatively, a glow switch type FS-4 may be connected across the capacitor and designed not to break down at the normal operating range of the power-reducing capacitor 56, but at high voltage to break down and short it out. Utilizing this glow switch, the bimetal within the switch is held permanently in the shorting position by a lock-in feature once the glow switch breaks down. Both the thermistor and glow switch should fall within the dimension requirements previously stated.

What we claim is:

1. In combination with an instant-start series-sequence fluorescent lamp system including a pair of input terminal means for connecting said system to a power source, a pair of fluorescent lamp means each comprising a elongated tubular vitreous envelope enclosing a discharge-sustaining filling and carrying phosphor means on the inner surface thereof, substantially hollow vitreous re-entrant stem presses sealed to each end portion of said envelope, and having lead-in means sealed therethrough and operatively supporting electrodes within said envelope proximate each end portion thereof, transformer means including a primary winding, a secondary winding and an auxiliary winding, a first of said lamp means having one of said electrodes in circuit between one of said input terminal means and one end of said primary winding, the other of said electrodes of said first lamp means in circuit with a point common to one end of said secondary winding and one end of said auxiliary winding, the second of said lamp means having one of said electrodes in circuit between the other of said input terminals and the other end of said primary winding, the other of said electrodes of said second lamp means in circuit with the other end of said secondary winding, the other end of said auxiliary winding in circuit with said one end of said primary winding, intermediate capacitor means in circuit between said common point and said other electrode of said first lamp means, the improvement which comprises:

a power reducing capacitor means of predetermined capacitance in series circuit with said first lamp means and a protective device comprising one of (1) a current-responsive fusible member which is in series circuit with said power-reducing capacitor means and is responsive to a current overload to render said lamp inoperative, and (2) a voltage-responsive switch means which is connected in parallel with said power-reducing capacitor means and which normally displays a high impedance, said high voltage-responsive switch means is responsive to a predetermined voltage developed across said power-reducing capacitor to switch to a low-impedance state and effectively remove said power-reducing capacitor means from circuit, whereby said lamp system is protected from overload conditions encountered upon failure of either said first or second lamp means.

2. A retrofit fluorescent lamp adapted for operation in an instant-start series-sequence two lamp system and which operates with a power consumption which is reduced from that power consumption at which said lamp system is rated to operate fluorescent lamps, said retrofit fluorescent lamp comprising:

an elongated tubular vitreous envelope enclosing a discharge-sustaining filling and carrying phosphor means on the inner surface thereof, substantially hollow elongated re-entrant stem presses sealed to each end portion of said envelope and having lead-in means sealed therethrough and operatively supporting electrodes within said envelope proximate each end portion thereof, end cap means sealed to each envelope end portion and each supporting a single contact member for energizing said lamp from said lamp system, and said lead-in means electrically connecting to said single contact member, at least of one of said substantially hollow vitreous re-entrant stem presses of said lamp protruding into the space within said envelope to form a cavity within said one step press of predetermined size and shape within one of said end portions of said envelope and which stem press cavity is sealed from the environment contained within said envelope;

a power-reducing capacitor means of predetermined dimensions and capacitance housed within said one re-entrant stem cavity and in series circuit between the proximate electrode and the proximate single contact member and a protective device of predetermined dimensions housed within said one re-entrant stem cavity and in circuit with said power-reducing capacitor means, said protective device comprising one of (1) a current responsive fusible member which is in series circuit with said power-reducing capacitor means and is responsive to a current overload to render said lamp inoperative, and (2) a voltage-responsive switch means which is connected in parallel with said power-reducing capacitor means and which normally displays a high impedance, said voltage-responsive switch means is responsive to a predetermined voltage developed across said power-reducing capacitor to switch to a low-impedance state and effectively remove said power-removing capacitor means from circuit, whereby said lamp system is protected from overload conditions encountered upon failure of one of said lamps.

* * * * *